US006769376B2

(12) United States Patent
Perera et al.

(10) Patent No.: US 6,769,376 B2
(45) Date of Patent: Aug. 3, 2004

(54) TRANSFER CONDUIT SYSTEM, APPARATUS, AND METHOD

(75) Inventors: Ravi Perera, Houston, TX (US); Neal Prescott, Houston, TX (US)

(73) Assignee: Coflexip, S.A., Le Trait (FR)

( * ) Notice: Subject to any disclaimer, the term of this patent is extended or adjusted under 35 U.S.C. 154(b) by 0 days.

(21) Appl. No.: 10/162,266

(22) Filed: Jun. 4, 2002

(65) Prior Publication Data

US 2003/0224674 A1 Dec. 4, 2003

(51) Int. Cl.[7] ..... B63B 21/00

(52) U.S. Cl. ..... 114/230.13; 441/4; 405/224.2; 138/112; 248/68.1

(58) Field of Search ..... 114/230.1, 230.13; 441/1–5; 405/154.1, 158, 164, 167, 178, 184.4, 184.5, 224.2, 224.3, 224.4; 138/106, 111, 112; 285/121.1, 121.6, 124.2; 166/345, 347, 350, 367; 248/49, 68.1, 74.1, 74.2, 74.3, 82–92

(56) References Cited

U.S. PATENT DOCUMENTS 3,385,545 A * 5/1968 Patton ..... 248/68.1
3,708,811 A * 1/1973 Flory ..... 441/5
3,811,142 A * 5/1974 Westra ..... 441/4
3,978,804 A * 9/1976 Beynet et al. ..... 405/224
4,031,919 A * 6/1977 Ortloff et al. ..... 137/799
4,194,568 A * 3/1980 Buresi et al. ..... 166/340
4,198,179 A * 4/1980 Pease et al. ..... 405/224.2
4,271,551 A * 6/1981 Tanaka ..... 441/133
4,363,567 A * 12/1982 Van der Graaf ..... 405/224.2
4,388,022 A * 6/1983 Gentry et al. ..... 405/224.3
4,459,066 A * 7/1984 van der Graaf ..... 405/224.3
4,704,050 A * 11/1987 Wallace ..... 405/224.2
4,762,180 A * 8/1988 Wybro et al. ..... 166/350
5,244,312 A * 9/1993 Wybro et al. ..... 405/204
5,697,447 A * 12/1997 B.o slashed.rseth ..... 166/366
6,062,769 A * 5/2000 Cunningham ..... 405/195.1
6,406,222 B1 * 6/2002 Pollack ..... 405/224
6,461,083 B1 * 10/2002 Pionetti et al. ..... 405/224.2

* cited by examiner

*Primary Examiner*—S. Joseph Morano
*Assistant Examiner*—Ajay Vasudeva
(74) *Attorney, Agent, or Firm*—Klein, O'Neill & Singh, LLP; Howard J. Klein

(57) ABSTRACT

The present invention relates to systems and methods for prevention of clashing between multiple conduits spaced closely together and to methods of installation of multiple conduits at the same time. Various aspects of the invention are provided involving separating the at least two transfer conduits, and allowing relative motion between the at least two transfer conduits.

33 Claims, 6 Drawing Sheets

TRANSFER CONDUIT SYSTEM, APPARATUS, AND METHOD

BACKGROUND OF THE INVENTION

This invention generally relates to fluid transfer conduits (generally steel-walled, and single-walled) that are suspended between two work platforms. Examples of such work platforms include production platforms and drilling platforms (whether floating or weighted to a marine floor, or otherwise), floating service vessels (e.g. FPSOs), and other work platforms that will occur to those of skill in the art. Such conduits are typically referred to as "catenary" fluid transfer conduits. The invention also relates to systems and methods for prevention of clashing between multiple conduits spaced closely together and to methods of installation of multiple conduits at the same time.

Referring now to FIG. 1, a platform 1 is seen being serviced by floating vessel 2. Platform 1 is held in place by mooring 3, and floating vessel 2 is held by mooring 4 connected to turret 5. Connected between turret 5 and platform 1 are catenary conduits 6*a*–6*c* for transfer of fluids between platform 1 and floating vessel 2. Thermal expansion and other phenomena (e.g. internal pressure fluctuations) cause catenary conduits 6*a*–6*c* to move relative to each other. If made the same length, they would be too close together in the middle area between platform 1 and vessel 2 and would clash. Therefore, catenary conduits 6*a*–6*c* have different lengths—to prevent them from clashing. Since they are different lengths, however, there are problems.

For example, using different lengths for transfer conduits means that only one transfer conduit is of an optimum length for the particular installation. The additional length of the other transfer conduits, needed to avoid clashing, costs extra money in materials, manufacturing time, installation, towing loads, etc. Therefore, there is a need for a multiple transfer conduit system having transfer conduits of substantially the same length.

Also, each of catenary conduits 6*a*–6*c* must be towed individually to the location where platform 1 has been moored. The use of multiple vessels for towing the catenary conduits and the production downtime during the installation of each individual catenary conduit 6*a*–6*c* is expensive. Thus, there is also a need for a conduit system between two work platforms that allows for the installation of, and towing of, multiple catenary conduits at one time.

One proposed system for addressing this problem is to use "flexible" conduits. Such conduits are made of multiple layers and are extremely expensive to fabricate. However, due to their particular thermal-expansion qualities, which are much less than the thermal-expansion qualities of the steel pipe catenary conduits illustrated in FIG. 1, flexible conduits can be rigidly clamped together in the middle section between platform 1 and floating vessel 2. Thus, the flexible conduits are made substantially the same length. However, as mentioned before, flexible conduits are more expensive.

Thus, there is a continuing, long-felt need, for a system of steel catenary conduits between a production platform and service vessel in which the transfer conduits having high expansion properties are substantially the same length but do not clash.

SUMMARY OF THE INVENTION

Problems described above are addressed by various embodiments of the invention. Common to all embodiments is the separation of transfer conduits while allowing relative motion between them.

According to one aspect of the invention, an apparatus is provided for separating at least two transfer conduits connected between at least two work platforms while allowing for relative motion between the at least two transfer conduits. The apparatus comprises: a first transfer conduit engagement member, a second transfer conduit engagement member, and a separation member between the first and the second transfer conduit engagement members. The separation member allows for relative motion between the first transfer conduit engagement member and the second transfer conduit engagement member while maintaining a minimum distance between the first transfer conduit engagement member and the second transfer conduit engagement member.

According to a more specific example embodiment, the first and second transfer conduit engagement members comprise curved members having inner surfaces arranged for frictional engagement with the first and second transfer conduits, respectively. In some examples, the curved members comprise multi-piece clamps for substantially surrounding the transfer conduits. In another specific embodiment, for use with a third transfer conduit, a third engagement member and a separation member are provided between first and third transfer conduit engagement members.

According to a further aspect of the invention, an apparatus is provided comprising: a means for separating at least two transfer conduits and a means for allowing relative motion between the at least two transfer conduits. In one specific example embodiment, the means for separating comprises a substantially inflexible separation member pivotally connected to at least one of the transfer conduits (for example, through a first collar substantially surrounding a first of the at least two transfer conduits and through a second collar substantially surrounding a second of the at least two transfer conduits). In a further example, there is provided a means for separating a further transfer conduit connected between the at least two work platforms from the at least two transfer conduits.

According to yet another aspect of the invention, a work platform transfer conduit bundle is provided. In this aspect, the bundle comprises at least two transfer conduits, wherein at least one of the at least two transfer conduits comprises a material having a total expansion coefficient (contributed to by, e.g., thermal expansion and internal pressure) sufficient to clash with the other of the transfer conduits at a spacing of the transfer conduits in the bundle, means for separating the at least two transfer conduits, and means for allowing relative motion between the at least two transfer conduits.

In a specific example, means for towing the at least two transfer conduits is also provided (for example, a clamp holding a first end of the at least two transfer conduits). In some examples, the clamp comprises a substantially inflexible clamp and a tow-line receptacle (e.g. a padeye).

In some examples, the means for allowing relative motion between the at least two transfer conduits comprises a substantially rigid separation member pivotally attached to the at least one of the at least two transfer conduits.

According to a further embodiment, buoyancy means (a volume having a density less than water) is attached to the means for separating the at least two transfer conduits. Some examples use a housing entrapping a gas (e.g., a steel can, composite cylinder or other shape, plastic housing, etc.). Other examples use a material in solid phase wherein the material has a density less than water (e.g, urethane, foam, etc.).

In still a further example embodiment of the invention, a tie-down is provided for the buoyancy means, wherein the tie-down holds the buoyancy means in a fixed spacing to the transfer conduits. In as more specific example, a means is provided for holding the buoyancy means in a spaced relation to the transfer conduits (for example, a substantially inflexible line, such as a wire rope or strap) surrounding the buoyancy means and the transfer conduits.

In an even further example embodiment, a separator is provided between the buoyancy means and the transfer conduits, and further separators are between the transfer conduits.

According to yet another aspect of the invention, a method is provided for installation of transfer conduits between a pair of work platforms. The method comprises: towing a bundle of transfer conduits to the work platforms, wherein at least one of the at least two transfer conduits comprises a material having a total expansion coefficient sufficient to clash with the other of the transfer conduits at a spacing of the transfer conduits in the bundle, separating the at least two transfer conduits, and allowing relative motion between the at least two transfer conduits, connecting a first end of a first transfer conduit of the bundle to a first of the pair of work platforms. The method further comprises: connecting a second end of the first transfer conduit of the bundle to a second of the pair of work platforms, connecting a first end of a second transfer conduit of the bundle to the first of the pair of work platforms, and connecting a second end of the second transfer conduit of the bundle to the second of the pair of work platforms. In some embodiments, tow loads of the first end of the first transfer conduit and the second transfer conduit is transferred to a first work vessel in the same load transfer operation.

DETAILED DESCRIPTION OF EXAMPLE EMBODIMENTS

Figure 1:
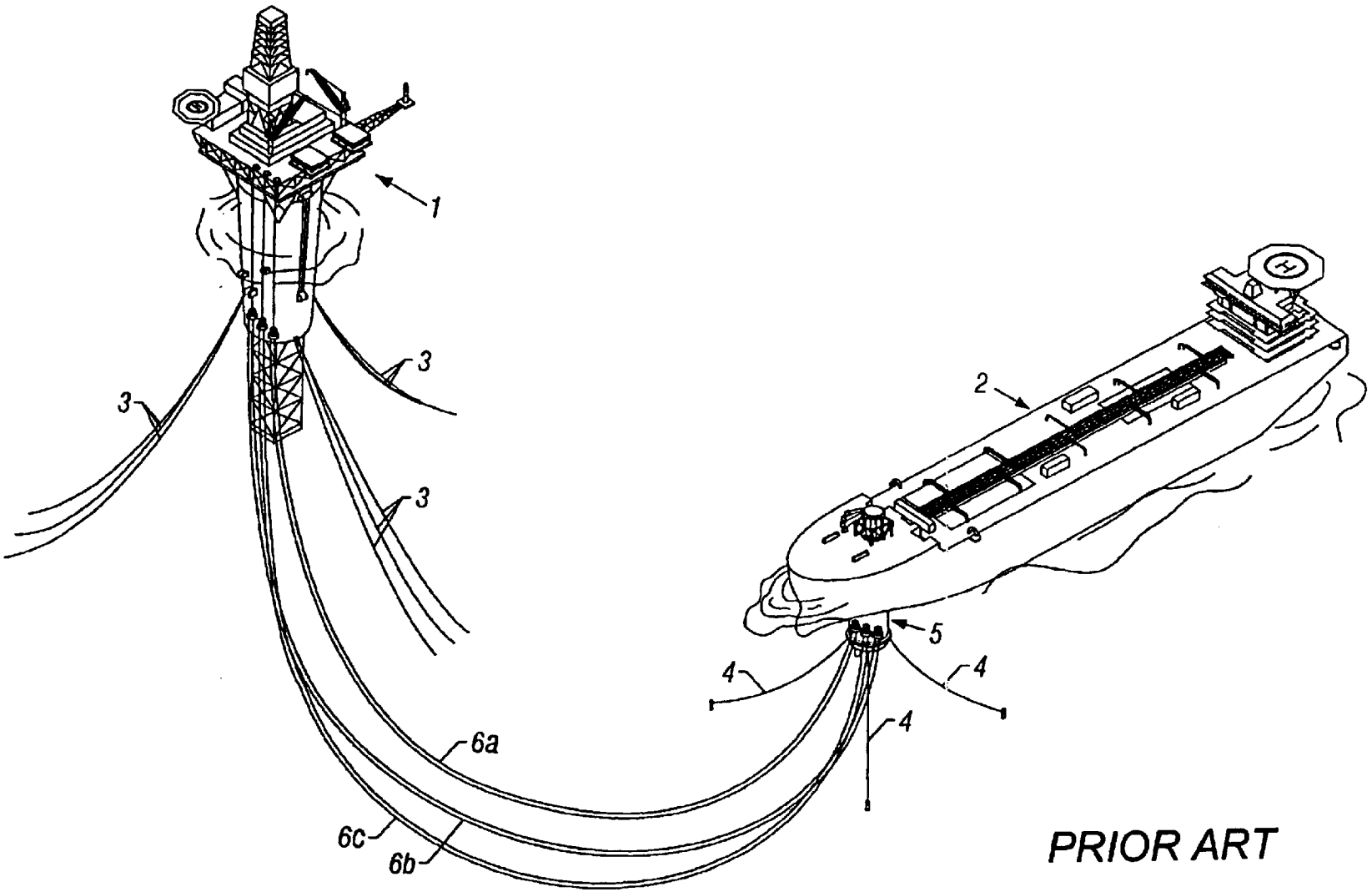
PRIOR ART FIG. 1
FIG. 1 shows a perspective view of an example of the prior art.
Figure 2:
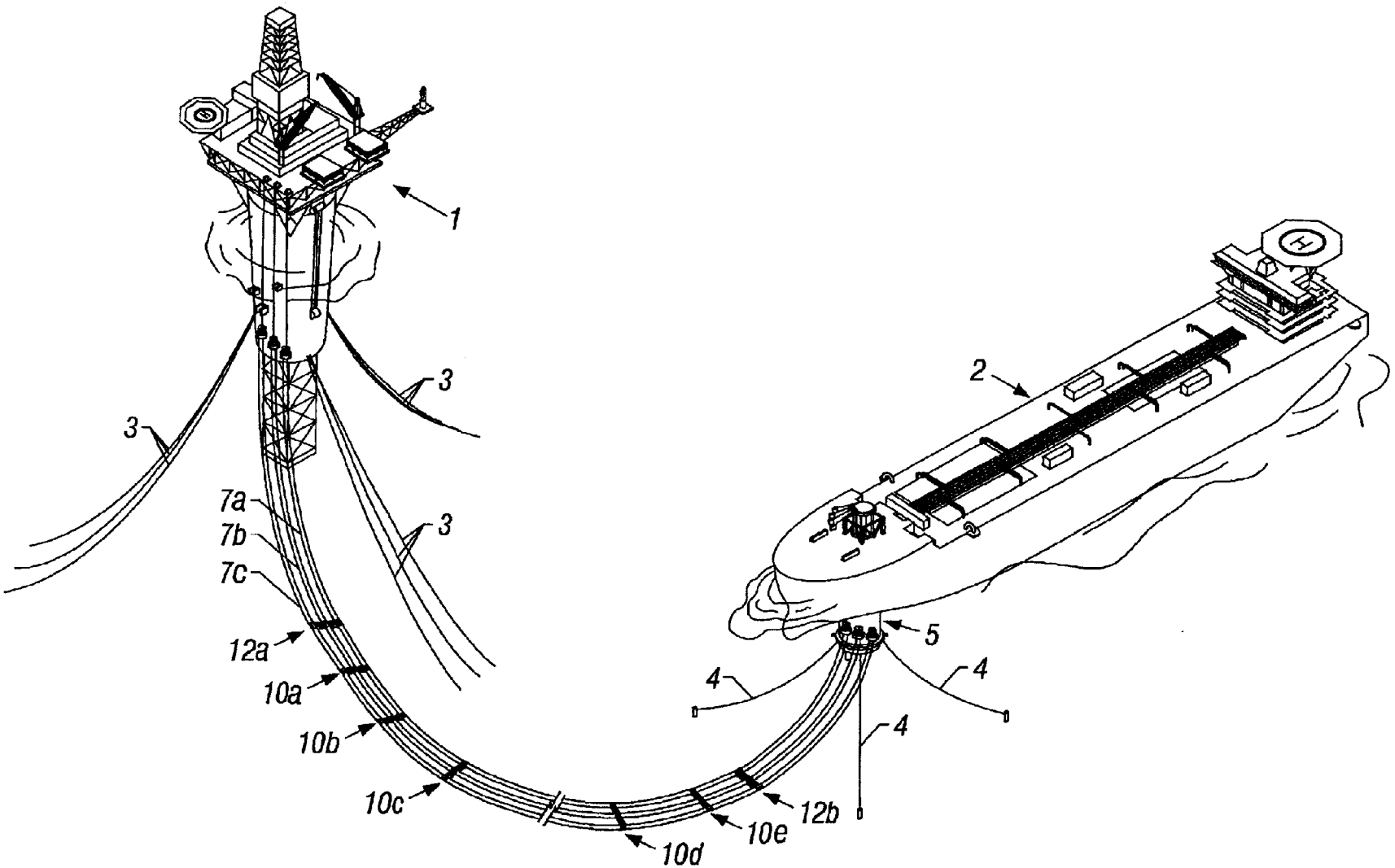
FIG. 2 shows a perspective view of an example embodiment of the present invention.

Referring now to FIG. 2, the system of FIG. 1 is seen, but the catenary conduits 6*a*–6*c* have been replaced with conduits, 7*a*, 7*b*, and 7*c*, all of which comprise materials having relatively high thermal-expansion co-efficient, as in FIG. 1 (for example, steel, single-walled conduits). However, unlike the conduits of FIG. 1, conduits 7*a*–7*c* are substantially the same length. The clashing is avoided in the example embodiment of FIG. 2 through the use of flexible clamps 10*a*–10*e* spaced along the middle portion between platform 1 and floating vessel 2. Substantially rigid clamps 12*a* and 12*b* are positioned toward the ends of conduits 7*a*–7*c* where relative motion due to thermal-expansion is relatively small. The particular spacing of flexible clamps 10*a*–10*e* will vary depending on the particular production location. Also, the use of substantially rigid clamps 12*a* and 12*b* will vary, also depending on the production location. For example, in alternative embodiments of the invention (not shown) no rigid clamps are used. Further, according to other alternative embodiments, only a few, or even one flexible clamp 10 is used, while and still other alternative embodiments, more than 5 flexible clamps 10 are used.

As thermal-expansion occurs, in conduits 7*a*–7*c*, flexible clamps 10*a*–10*e* allow for relative motion between conduits 7*a*–7*c*. Although the thermal expansion is substantially axial in conduits 7*a*–7*c*, the relative motion between the conduits is, when clamped, substantially normal to the conduit axis.

Figure 3:
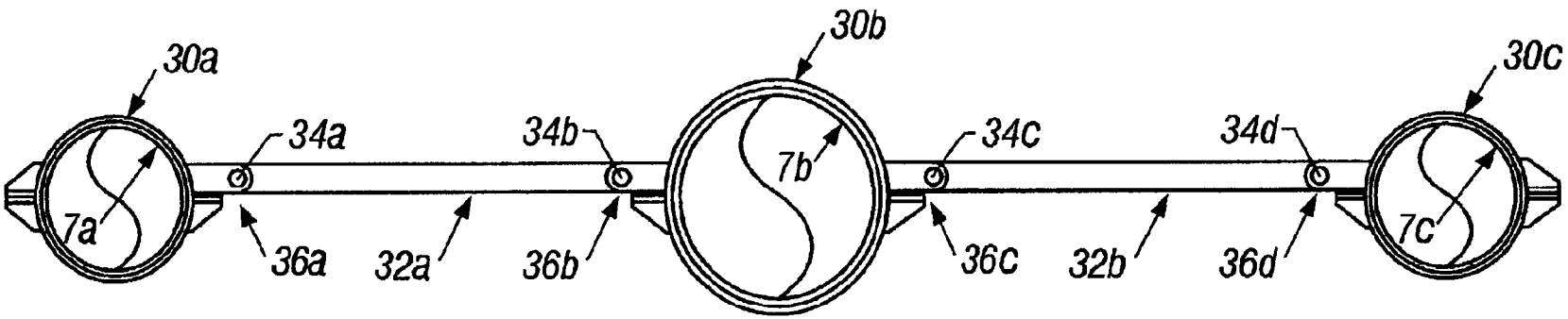
FIG. 3 shows a side view of an example embodiment of the present invention.

FIG. 3 shows an example of an embodiment of flexible clamps 10*a*–10*e* of FIG. 2. As seen, conduits 7*a*–7*c* (which are not necessarily the same diameter) are held by friction members 30*a*–30*c* (for example, steel semi-cylinders tensioned around conduits 7*a*–7*c*). Separation members 32*a* and 32*b* separate friction members 30*a*–30*c* and are connected between the friction members by pivotal connections 34*a*–34*d*. In various examples, pivotal connections 34*a*–34*d* comprise pins installed through holes in each end of separation members 32*a* and 32*b* and in holes on protrusions 36*a*–36*d* from friction members 30*a*–30*c*. According to an alternative embodiment, the separation members 32*a* and 32*b* between friction members 30*a*–30*c* comprise less rigid material, eliminating a pivotal connection and providing flexure through bending and separation members 32*a* and 32*b*, themselves. While in alternative embodiments of the invention, more than 3 conduits are clamped as described in FIG. 3, there is a particular advantage to using no more than 3. That is due to the fact that a third separation member and a fourth pipe would reduce the amount of flexibility in the system.

Figure 4:
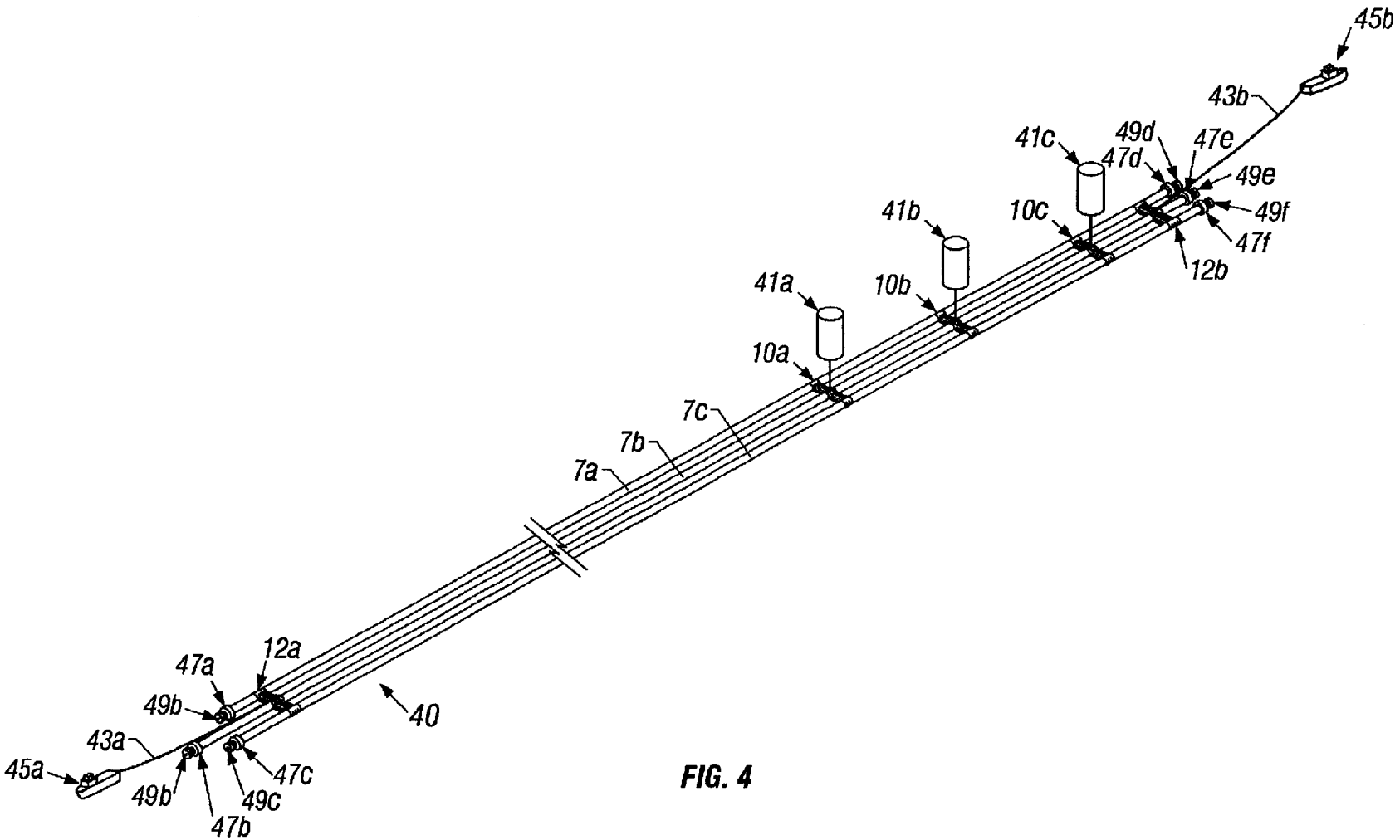
FIG. 4 shows a perspective view of an example embodiment of the present invention.
Figure 5:
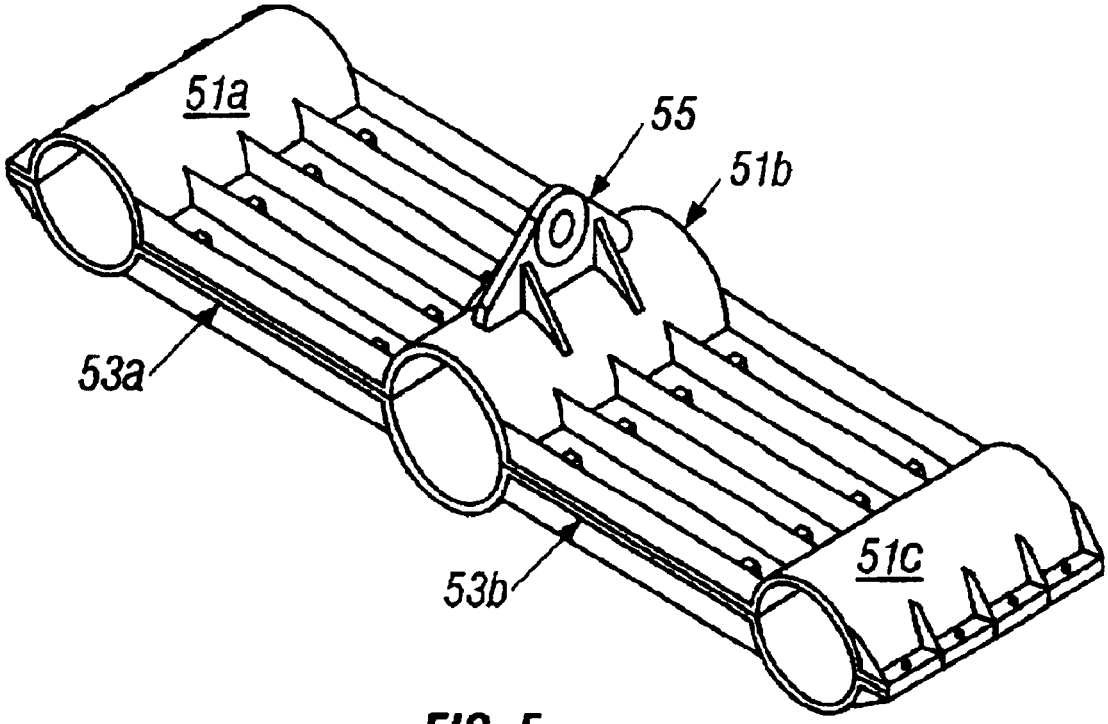
FIG. 5 shows a perspective view of an example embodiment of the present invention.

In one specific embodiment of the invention, a conduit bundle (comprising conduits held by flexible clamps, a specific example of which is seen in FIG. 2) is constructed on-shore, and towed as a unit to a location where a floating production platform and floating vessel are located. An example of such a bundle 40 is seen in FIG. 4 in which conduits 7*a*–7*c* are held by flexible clamps spaced approximately 200 feet apart for a 10,000 foot bundle 40. Although only 3 flexible clamps 10*a*–10*c* are shown, it would be understood that more are used in practice. To allow for near-surface towing, flotation members 41*a*–41*c* are connected to clamps 10*a*–10*c*. In the illustrated embodiment, flotation members 41*a*–41*c* comprise flotation buoys. Substantially rigid end clamps 12*a* and 12*b* are used to attach tow and handling lines 43*a* and 43*b* to tow and handling vessels 45*a* and 45*b*, respectively. At the end of each conduit 7*a*–7*c*, flexible joints 47*a*–47*f* are installed with blind flanges and with padeyes 49*a*–49*f*. Referring now to FIG. 5, an example end clamp 12*a* and 12*b* (FIG. 4) is seen in which friction members 51*a*–51*c* (for example, ¾" thick steel plate), are rigidly connected by separators 53*a* and 53*b* (comprising, for example, steel). A tow padeye 55 is connected to friction member 51*b* for attachment of tow and handling lines 43*a* and 43*b* (FIG. 4).

While the towing arrangement of FIG. 4 is useful in relatively deep water, it is not practical in relatively shallow water that may occur near shore. Accordingly, as seen in the example embodiment of FIG. 6, in some towing examples, flotation buoys 41 lie substantially axially along conduit 7*b*.

Figure 6:
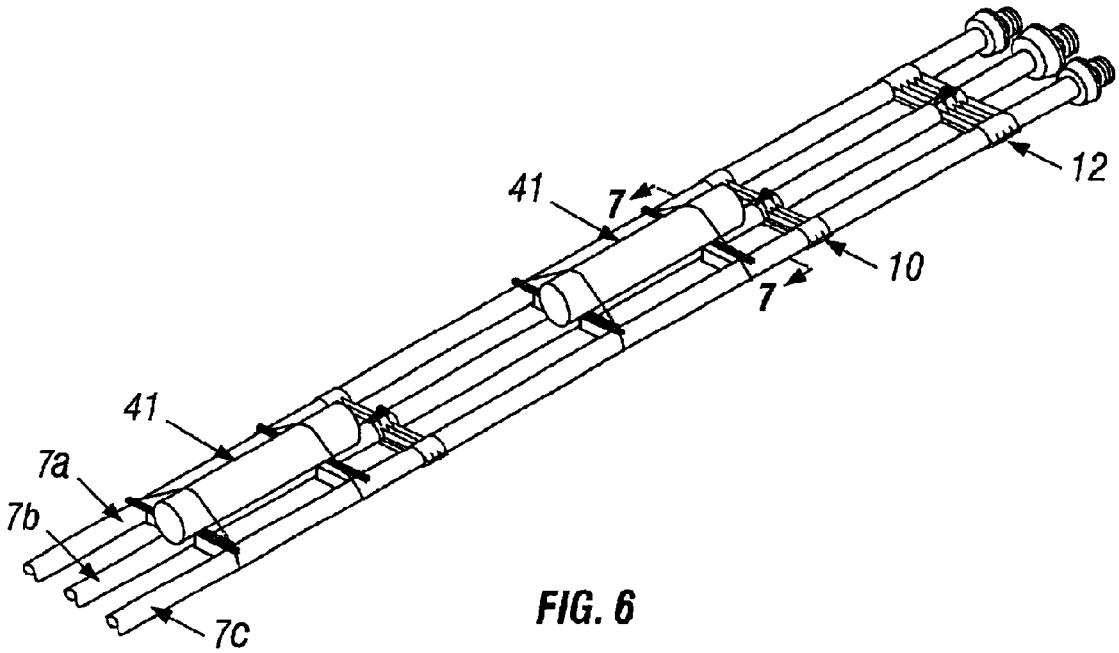
FIG. 6 shows a perspective view of an example embodiment of the present invention.
Figure 7:
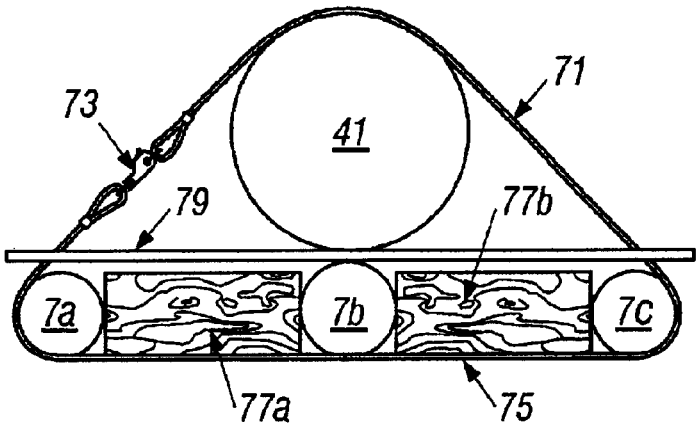
FIG. 7 shows a sectional view of an example embodiment of the present invention.

Referring to FIG. 7, a sectional view through line A of FIG. 6 is seen in which buoy 41 is held via wire 71 which surrounds conduits 7*a*–7*c* and is attached with quick disconnect 73. To protect conduits 7*a*–7*c*, a 1¾" plate 75 is formed with curves around conduits 7*a*–7*c*. Two timber supports 77*a* and 77*b* are placed between conduits 7*a* and 7*b* and between conduits 7*b* and 7*c*, respectively. Also provided, as protection for conduits 7*a* and 7*c*, is sheet 79 (also made of wood, e.g. plywood, in a number of embodiments).

Referring again to FIG. 4, once the bundle 40 has been towed to the location where the vessel and production platform are located, handling vessels 45*a* and 45*b* transfer their respective loads to the production platform and vessel, and the blind flanges with padeyes 49*a*–49*f* are used in conjunction with flexible joints 47*a*–47*f* to make the specific connections needed to the platform and the vessel.

The above explanation has been given by way of example only. Other embodiments of the invention will occur to those who are skilled in the art without departing from the spirit and scope of the invention as defined herein.

What is claimed is:

1. Apparatus for holding first and second rigid transfer conduits in a spaced relationship, each of the transfer conduits having a first end and a second end, the apparatus comprising:

a flexible clamp connecting the first and second transfer conduits so as to maintain a minimum special separation therebetween while allowing relative motion therebetween; and a rigid clamp fixed to the first and second transfer conduits near at least one of the first and second ends thereof so as to maintain said minimum spacial separation therebetween while substantially preventing relative motion therebetween.

2. The apparatus of claim 1, wherein the flexible clamp comprises:

a first conduit engagement member configured to securely engage the first transfer conduit;

a second conduit engagement member configured to securely engage the second transfer conduit; and a separation member pivotally connected to the first conduit engagement member and to the second conduit engagement member.

3. An apparatus as in claim 2, wherein the first transfer conduit engagement member comprises a first curved member having an inner surface arranged for frictional engagement with the first transfer conduit.

4. An apparatus as in claim 2 wherein the second transfer conduit engagement member comprises a second curved member having an inner surface arranged for frictional engagement with the second transfer conduit.

5. An apparatus as in claim 4 wherein each of the first and second curved members comprises a multi-piece clamp that substantially surrounds the first and second transfer conduits, respectively.

6. An apparatus as in claim 2, further comprising a third transfer conduit engagement member configured for securely engaging a third rigid transfer conduit, and a second separation member between the first and third transfer conduit engagement members.

7. An apparatus as in claim 2 wherein the separation member comprises a substantially inflexible separation member pivotally connected to at least one of the transfer conduit engagement members.

8. An apparatus as in claim 7, wherein the substantially inflexible separation member is pivotally connected to the first and second transfer conduit engagement members.

9. An apparatus as in claim 8 wherein the first and second transfer conduit engagement members are, respectively, a first collar substantially surrounding the first transfer conduit and a second collar substantially surrounding the second transfer conduit.

10. An apparatus as in claim 9 further comprising a separator of a further rigid transfer conduit from the first and second transfer conduits.

11. An apparatus as in claim 10, wherein the separator of a further rigid transfer conduit comprises a further substantially inflexible separation member.

12. An apparatus as in claim 11 wherein the further substantially inflexible separation member is pivotally connected to at least one of the transfer conduit engagement members.

13. The apparatus of claim 2, wherein the rigid clamp comprises:

a third conduit engagement member configured to securely engage the first transfer conduit; and a fourth conduit engagement member rigidly connected to the third conduit engagement member and configured to securely engage the second transfer conduit.

14. The apparatus of claim 1, further comprising a buoyancy element attached to at least one of the first and second transfer conduits.

15. The apparatus of claim 1, wherein the separation member is a substantially rigid member.

16. The apparatus of claim 1, wherein each of the first and second conduit engagement members comprises a collar fixed around its respective transfer conduit.

17. A work platform transfer conduit bundle comprising:

at least two transfer conduits, wherein at least one of the at least two transfer conduits comprises a material having a total expansion coefficient sufficient to clash with the other of the transfer conduits at a spacing of the transfer conduits in the bundle, means for separating the at least two transfer conduits, means for allowing relative motion between the at least two transfer conduits, buoyancy means attached to the means for separating the at least two transfer conduits, and a separator between the buoyancy means and the transfer conduits.

18. A bundle as in claim 17, further comprising means for towing the at least two transfer conduits.

19. A bundle as in claim 18, wherein the means for towing the at least two transfer conduits comprises a clamp holding a first end of the at least two transfer conduits.

20. A bundle as in claim 19, wherein the clamp comprises a substantially inflexible clamp.

21. A bundle as in claim 19 wherein the clamp comprises a tow-line receptacle.

22. A bundle as in claim 21 wherein the tow-line receptacle comprises a padeye.

23. A bundle as in claim 22 wherein the means for allowing relative motion between the at least two transfer conduits comprises a substantially rigid separation member.

24. A bundle as in claim 23 wherein the substantially rigid separation member is pivotally attached to at least one of the at least two transfer conduits.

25. A bundle as in claim 24 wherein the substantially rigid separation member is pivotally attached to a second of the at least two transfer conduits.

26. A bundle as in claim 25 further comprising a further separator between the transfer conduits.

27. A bundle as in claim 17 wherein the buoyancy means comprises a buoyancy housing entrapping a gas.

28. A bundle as in claim 17 wherein the buoyancy means comprises a material in solid phase wherein the material has a density less than water.

29. A bundle as in claim 17, further comprising a tie-down for the buoyancy means wherein the tie-down holds the buoyancy means in a fixed spacing to the transfer conduits.

30. A bundle as in claim 17 further comprising means for holding the buoyancy means in a spaced relation to the transfer conduits.

31. A bundle as in claim 30 wherein the means for holding comprises a substantially inflexible line surrounding the buoyancy means and the transfer conduits.

32. A work platform transfer conduit bundle comprising:

at least two transfer conduits, wherein at least one of the at least two transfer conduits comprises a material having a total expansion coefficient sufficient to clash with the other of the transfer conduits at a spacing of the transfer conduits in the bundle, means for separating the at least two transfer conduits, means for allowing relative motion between the at least two transfer conduits, buoyancy means attached to the means for separating the at least two transfer conduits, and a tie-down that holds the buoyancy means in a fixed spacing relative to the transfer conduits.

33. A bundle as in claim 32, further comprising a separator between the buoyancy means and the transfer conduits.

* * * * *

UNITED STATES PATENT AND TRADEMARK OFFICE

CERTIFICATE OF CORRECTION

PATENT NO. : 6,769,376 B2
DATED : August 3, 2004
INVENTOR(S) : Ravi Perera et al.

It is certified that error appears in the above-identified patent and that said Letters Patent is hereby corrected as shown below:

Column 5,
Line 25, the word “special” should read as -- spacial --.
Line 46, the phrase “claim 2” should read as -- claim 3 --.

Signed and Sealed this

Eighth Day of February, 2005

JON W. DUDAS
*Director of the United States Patent and Trademark Office*